US006824005B1

(12) United States Patent
Ashinhurst

(10) Patent No.: US 6,824,005 B1
(45) Date of Patent: Nov. 30, 2004

(54) LINING REFUSE RECEPTACLE DEVICE, KIT AND METHOD

(76) Inventor: Kenneth C. Ashinhurst, 85 N. Shorthom Dr., Camp Verde, AZ (US) 86322

( * ) Notice: Subject to any disclaimer, the term of this patent is extended or adjusted under 35 U.S.C. 154(b) by 0 days.

(21) Appl. No.: 10/731,590

(22) Filed: Dec. 9, 2003

(51) Int. Cl.[7] ..... B65D 25/14

(52) U.S. Cl. ..... 220/495.07; 206/408; 206/225; 206/226

(58) Field of Search ..... 220/495.07; 206/408, 206/225, 226

(56) References Cited

U.S. PATENT DOCUMENTS

| | | | | | |
|---|---|---|---|---|---|
| 4,364,490 | A | | 12/1982 | Lang et al. | |
| 4,955,505 | A | | 9/1990 | Battaglia | |
| 5,115,935 | A | | 5/1992 | Lemongelli | |
| 5,322,179 | A | * | 6/1994 | Ting | 220/495.07 |
| 5,405,041 | A | | 4/1995 | Van Brackle | |
| 5,503,292 | A | | 4/1996 | Cuccharia | |
| 5,505,334 | A | | 4/1996 | Triglia | |
| 5,704,511 | A | * | 1/1998 | Kellams | 220/495.07 |
| D391,725 | S | | 3/1998 | Triglia | |
| 5,738,239 | A | | 4/1998 | Triglia | |
| 5,881,900 | A | * | 3/1999 | Meshorer | 220/495.07 |
| 6,199,714 | B1 | * | 3/2001 | Thompson | 220/495.07 |
| 6,283,321 | B1 | * | 9/2001 | Meshorer | 220/495.07 |

* cited by examiner

*Primary Examiner*—Joseph Man-Fu Moy

(57) ABSTRACT

An automatic lining refuse receptacle device, a kit for the device and an associated method of using same are disclosed for use in providing a means for conveniently holding and replacing trash liners from within a trash can. The device includes a base; a hinge; a spring latch; a collar; a dowel; a spindle; a catch; a bucket; and a ridge. The hinge is attached to the base. The spring latch is attached to the base. The collar is attached to the base. The dowel is pivotally attached to the collar. The spindle has a distal and proximate ends, in which the proximate end of the spindle is attached to the dowel. The catch is attached to the base, wherein the catch is capable of contacting the distal end of the spindle. The bucket is attached to the hinge, in which the bucket has a top rim and a bottom plate, wherein the bottom plate has an elongated slot cut through the bottom plate of the bucket. The ridge is attached to the bucket, wherein the ridge is capable of being clamped onto with the spring loaded latch. The bottom plate of the bucket can be rotated upwardly away from the base into an open position when the spring latch is not engaged with the ridge. The bottom plate of the bucket can also be rotated downwardly towards the base into a closed position wherein the spring latch is engageable with the ridge. The proximate end of the spindle can be rotated upwardly away from the base into a load position. The proximate end of the spindle can be rotated downwardly towards the base so that the proximate end of the rests on the catch in a dispensing position. The kit includes the device and a garbage bag roll. The method includes the steps of clamping, grabbing, gyrating, inserting, obtaining, revolving, rotating, securing, swiveling, threading, unclamping, and unwinding.

20 Claims, 2 Drawing Sheets

LINING REFUSE RECEPTACLE DEVICE, KIT AND METHOD

FIELD OF THE INVENTION

The present invention relates to trash receptacle lining systems, more particularly pertains to a lining refuse receptacle device, a kit for the device and an associated method of using the same.

BACKGROUND OF THE INVENTION

Utilizing conventional trash receptacles, an individual must remove a filled trash bag and subsequently manually install a new bag within the receptacle. This forces the individual to bend over and to have manual contact with the frequently soiled interior of the trash receptacle. Therefore there is a need for an improved device, kit and method of using the same which can at least minimize this inconvenience. A wide variety of trash liner systems is currently available on the commercial market and an even larger number of these types of devices are known in the art of trash liner systems, for example, the refuse receptacle with bag liners supplied through the bottom from replaceable liner supply packages disclosed by Lang et al. in U.S. Pat. No. 4,364,490; the trash receptacle lining system disclosed by Battaglia in U.S. Pat. No. 4,955,505; the disposable bag box for trash receptacle disclosed by Lemongelli in U.S. Pat. No. 5,115,935; the self dispensing trash liner pail disclosed by Van Brackle in U.S. Pat. No. 5,405,041; the system for automatically lining a trash receptacle in U.S. Pat. No. 5,503,292; the trash container liner dispensing system disclosed by Triglia in U.S. Pat. No. 5,505,334; the trash container liner dispensing system disclosed by Triglia in U.S. Pat. No. 5,738,239; and the trash bag roll retainer/dispenser disclosed by Triglia in U.S. Pat. No. D391,725.

While all of the above-described devices fulfill their respective, particular objectives and requirements, the aforementioned patents do not describe an automatic lining refuse receptacle device having a base; a hinge; a spring latch; a collar; a dowel; a spindle; a catch; a bucket; and a ridge. This combination of elements would specifically match the user's particular individual needs of making it possible to makes it possible to provide a means for conveniently holding and replacing trash liners within a trash bucket. The above-described patents make no provision for an automatic lining refuse receptacle device having a base; a hinge; a spring latch; a collar; a dowel; a spindle; a catch; a bucket; and a ridge.

Therefore, a need exists for a new and improved automatic lining refuse receptacle device having a base; a hinge; a spring latch; a collar; a dowel; a spindle; a catch; a bucket; and a ridge. In this respect, the automatic lining refuse receptacle device according to the present invention substantially departs from the conventional concepts and designs of the prior art, and in doing so provides an apparatus primarily developed for the purpose of providing a means for conveniently holding and replacing trash liners within a trash bucket.

SUMMARY OF THE INVENTION

The present device, kit and method of using, according to the principles of the present invention, overcomes the shortcomings of the prior art by providing a novel and nonobvious automatic lining refuse receptacle device, kit and method of using the same. The device includes a base; a hinge; a spring latch; a collar; a dowel; a spindle; a catch; a bucket; and a ridge. The hinge is attached to the base. The spring latch is attached to the base. The collar is attached to the base. The dowel is pivotally attached to the collar. The spindle has a distal and proximate ends, in which the proximate end of the spindle is attached to the dowel. The catch is attached to the base, wherein the catch is capable of contacting the distal end of the spindle. The bucket is attached to the hinge, in which the bucket has a top rim and a bottom plate, wherein the bottom plate has an elongated slot cut through the bottom plate of the bucket. The ridge is attached to the bucket, wherein the ridge is capable of being clamped onto with the spring loaded latch. The bottom plate of the bucket can be rotated upwardly away from the base into an open position when the spring latch is not engaged with the ridge. The bottom plate of the bucket can also be rotated downwardly towards the base into a closed position wherein the spring latch is engageable with the ridge. The proximate end of the spindle can be rotated upwardly away from the base into a load position. The proximate end of the spindle can be rotated downwardly towards the base so that the proximate end of the rests on the catch in a dispensing position. The kit includes the device and a garbage bag roll. The method includes the steps of clamping, grabbing, gyrating, inserting, obtaining, revolving, rotating, securing, swiveling, threading, unclamping, and unwinding.

In view of the foregoing disadvantages inherent in the known type trash liner devices now present in the prior art, the present invention provides an improved automatic lining refuse receptacle device, which will be described subsequently in great detail, is to provide a new and improved automatic lining refuse receptacle device which is not anticipated, rendered obvious, suggested, or even implied by the prior art, either alone or in any combination thereof.

To attain this, the present invention essentially comprises a base; a hinge; a spring latch; a collar; a dowel; a spindle; a catch; a bucket; and a ridge. The hinge is attached to the base. The spring latch is attached to the base. The collar is attached to the base. The dowel is pivotally attached to the collar. The spindle has a distal and proximate ends, in which the proximate end of the spindle is attached to the dowel. The catch is attached to the base, wherein the catch is capable of contacting the distal end of the spindle. The bucket is attached to the hinge, in which the bucket has a top rim and a bottom plate, wherein the bottom plate has an elongated slot cut through the bottom plate of the bucket. The ridge is attached to the bucket, wherein the ridge is capable of being clamped onto with the spring loaded latch. The bottom plate of the bucket can be rotated upwardly away from the base into an open position when the spring latch is not engaged with the ridge. The bottom plate of the bucket can also be rotated downwardly towards the base into a closed position wherein the spring latch is engageable with the ridge. The proximate end of the spindle can be rotated upwardly away from the base into a load position. The proximate end of the spindle can be rotated downwardly towards the base so that the proximate end of the rests on the catch in a dispensing position.

There has thus been outlined, rather broadly, the more important features of the invention in order that the detailed description thereof that follows may be better understood, and in order that the present contribution of the art may be better appreciated.

The invention may also include a garbage bag roll. There are of course, additional features of the invention that will be described hereinafter and which will form the subject matter of the claims attached.

Numerous objects, features and advantages of the present invention will be readily apparent to those of ordinary skill in the art upon reading of the following detailed description of presently preferred, but nonetheless illustrative, embodiments of the present invention when taken in conjunction with the accompany drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved automatic lining refuse receptacle device that has all the advantages of the prior art automatic lining refuse receptacle device and none of the disadvantages.

It is another object of the present invention to provide a new and improved automatic lining refuse receptacle device that may be easily and efficiently manufactured and marketed.

An even further object of the present invention is to provide a new and improved automatic lining refuse receptacle device that has a low cost of manufacture with regard to both materials and labor, and which accordingly is then susceptible of low prices of sale to the consuming public, thereby making such multipurpose storage unit and system economically available to the buying public.

Still another object of the present invention is to provide a new automatic lining refuse receptacle device that provides in the apparatuses and methods of the prior art some of the advantages thereof, while simultaneously overcoming some of the disadvantages normally associated therewith.

Even still another object of the present invention is to provide a automatic lining refuse receptacle device having a base; a hinge; a spring latch; a collar; a dowel; a spindle; a catch; a bucket; and a ridge. This combination of elements makes it possible to provide a means for conveniently holding and replacing trash liners within a trash bucket.

Still another object of the present invention is to provide a kit comprises the device and a garbage bag roll.

Lastly, it is an object of the present invention to provide a new and improved method of using comprising the steps of clamping, grabbing, gyrating, inserting, obtaining, revolving, rotating, securing, swiveling, threading, unclamping, and unwinding.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and description matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DETAILED DESCRIPTION OF THE PREFERRED EMBODIMENT

Figure 1:
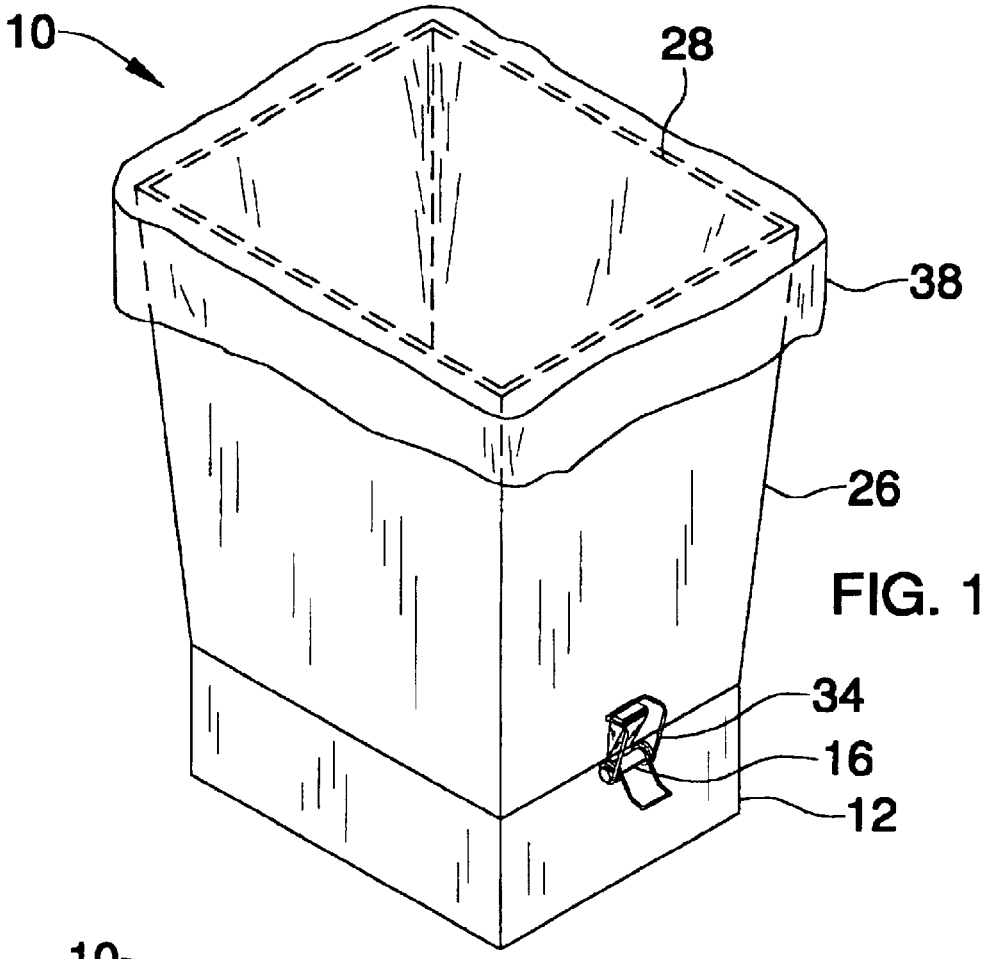
FIG. 1 is a perspective view of an preferred embodiment of the automatic lining refuse receptacle device constructed in accordance with the principles of the present invention.

Referring now to the drawings, and in particular FIG. 1 to 5 thereof, one preferred embodiment of the present invention is shown and generally designated by the reference numeral 10. One preferred embodiment of an automatic lining refuse receptacle device 10 comprises a base 12; a hinge 14; a spring latch 16; a collar 18; a dowel 20; a spindle 22; a catch 24; a bucket 26; and a ridge 34. The hinge 14 is attached to the base 12. The spring latch 16 is attached to the base 12. The collar 18 is attached to the base 12. The dowel 20 is pivotally attached to the collar 18. The spindle 22 has distal and proximate ends, the proximate end of the spindle 22 is attached to the dowel 20. The catch 24 is attached to the base 12, wherein the catch 24 is contacting the distal end of the spindle 22. The bucket 26 is attached to the hinge 14, the bucket 26 has a top rim 28 and a bottom plate 30, wherein the bottom plate 30 has an elongated slot 32 cut through the bottom plate 30 of the bucket 26. The ridge 34 is attached to the bucket 26, wherein the ridge 34 is capable of being clamped onto with the spring latch 16. The bottom plate 30 of the bucket 26 can be rotated upwardly away from the base 12 into an open position when the spring latch 16 is not engaged with the ridge 34. The bottom plate 30 of the bucket 26 can also be rotated downwardly towards the base 12 into a closed position wherein the spring latch 16 is engageable with the ridge 34. The distal end of the spindle 22 can be rotated upwardly away from the base 12 into a load position. The distal end of the spindle 22 can be rotated downwardly towards the base 12 so that the distal end of the rests on the catch 24 in a dispensing position.

An optional garbage bag roll 36 may be added to the device 10 wherein the optional garbage bag roll 36 is slidably attached to the spindle 22. The optional garbage bag roll 36 comprises a continuous length of a plurality of separable trash liners 38, wherein one trash liner 38 at a time can be retrieved by partially unwinding the garbage bag roll 36. The garbage bag roll 36 may be made of any commercially known material. One preferred configuration is that the garbage bag roll 36 is made of plastic selected from the group consisting of rubber, neoprene, polyvinyl chloride, polyester, polyethylene, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

The bucket 26 may be made of any commercially known material. One preferred configuration is that the bucket 26 is made of plastic selected from the group consisting of rubber, neoprene, polyvinyl chloride, polyester, polyethylene, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

The base 12 may be made of any commercially known material. One preferred configuration is that the base 12 is made of plastic selected from the group consisting of rubber, neoprene, polyvinyl chloride, polyester, polyethylene, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

The spindle 22 may be made of any commercially known material. One preferred configuration is that the spindle 22 is made of plastic selected from the group consisting of rubber, neoprene, polyvinyl chloride, polyester, polyethylene, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

The may be made of any commercially known material such as metal or plastic. One preferred configuration is that the spring latch 16 is made of plastic selected from the group consisting of rubber, neoprene, polyvinyl chloride, polyester, polyethylene, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

The collar 18 may be made of any commercially known material. One preferred configuration is that the collar 18 is made of plastic selected from the group consisting of rubber, neoprene, polyvinyl chloride, polyester, polyethylene, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

The dowel 20 may be made of any commercially known material. One preferred configuration is that the dowel 20 is made of plastic selected from the group consisting of rubber, neoprene, polyvinyl chloride, polyester, polyethylene, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

The hinge 14 may be made of any commercially known material. One preferred configuration is that the hinge 14 is made of plastic selected from the group consisting of rubber, neoprene, polyvinyl chloride, polyester, polyethylene, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof. Another preferred configuration is that the hinge 14 is a piano hinge 14.

The ridge 34 may be made of any commercially known material. One preferred configuration is that the ridge 34 is made of plastic selected from the group consisting of rubber, neoprene, polyvinyl chloride, polyester, polyethylene, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

The catch 24 may be made of any commercially known material. One preferred configuration is that the catch 24 is made of plastic selected from the group consisting of rubber, neoprene, polyvinyl chloride, polyester, polyethylene, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

One preferred embodiment of a kit for an automatic lining refuse receptacle device 10, wherein the kit comprises: a base 12; a hinge 14; a spring latch 16; a collar 18; a dowel 20; a spindle 22; a catch 24; a bucket 26; a ridge 34 and a garbage bag roll 36. The hinge 14 is attached to the base 12. The spring latch 16 is attached to the base 12. The collar 18 is attached to the base 12. The dowel 20 is pivotally attached to the collar 18. The spindle 22 has distal and proximate ends, the proximate end of the spindle 22 is attached to the dowel 20. The catch 24 is attached to the base 12, wherein the catch 24 is contacting the distal end of the spindle 22. The bucket 26 is attached to the hinge 14, the bucket 26 has a top rim 28 and a bottom plate 30, wherein the bottom plate 30 has an elongated slot 32 cut through the bottom plate 30 of the bucket 26. The ridge 34 is attached to the bucket 26, wherein the ridge 34 is capable of being clamped onto with the spring latch 16. The bottom plate 30 of the bucket 26 can be rotated upwardly away from the base 12 into an open position when the spring latch 16 is not engaged with the ridge 34. The bottom plate 30 of the bucket 26 can also be rotated downwardly towards the base 12 into a closed position wherein the spring latch 16 is engageable with the ridge 34. The distal end of the spindle 22 can be rotated upwardly away from the base 12 into a load position. The distal end of the spindle 22 can be rotated downwardly towards the base 12 so that the distal end of the rests on the catch 24 in a dispensing position. The garbage bag roll 36 is slidably attachable to the spindle 22, wherein the garbage bag roll 36 comprising a continuous length of a plurality of separable trash liners 38, wherein one trash liner 38 at a time can be retrieved by partially unwinding the garbage bag roll 36.

One preferred embodiment of a method of using a kit for an automatic lining refuse receptacle device 10, the method comprising the steps of: clamping, grabbing, gyrating, inserting, obtaining, revolving, rotating, securing, swiveling, threading, unclamping, and unwinding. The obtaining step comprises obtaining the kit comprising: a base 12; a hinge 14 attached to the base 12; a spring latch 16 attached to the base 12; a collar 18 attached to the base 12; a dowel 20 pivotally attached to the collar 18; a spindle 22 having distal and proximate ends, the proximate end of the spindle 22 is attached to the dowel 20; a catch 24 attached to the base 12, wherein the catch 24 is contacting the distal end of the spindle 22; a bucket 26 attached to the hinge 14, the bucket 26 having a top rim 28 and a bottom plate 30, wherein the bottom plate 30 having an elongated slot 32 cut through the bottom plate 30 of the bucket 26; a ridge 34 attached to the bucket 26, wherein the ridge 34 is clamped onto with the spring latch 16; and a garbage bag roll 36 slidably attachable to the spindle 22, the garbage bag roll 36 comprising a continuous length of a plurality of separable trash liners 38, wherein one trash liner 38 at a time can be retrieved by partially unwinding the garbage bag roll 36. The unclamping step comprises unclamping the spring latch 16 from the ridge 34. The rotating step comprises rotating upwardly the bottom plate 30 of the garbage away from the base 12 into an open position, wherein the rotating step performed when the spring latch 16 is unclamped. The gyrating step comprises gyrating upwardly the distal end of the spindle 22 away from the base 12 into a load position. The grabbing step comprises grabbing hold of the garbage bag roll 36. The inserting step comprises inserting slidably the spindle 22 through the garbage bag roll 36 when the spindle 22 is in the load position. The revolving step comprises revolving downwardly the distal end of the spindle 22 towards the base 12 so that the distal end of the spindle 22 contacts onto on the catch 24 wherein the rotating step places the spindle 22 in a dispensing position wherein the rotating step performed subsequent to the inserting step and performed when the spindle 22 is inserted through the garbage bag roll 36. The unwinding step comprises unwinding partially the garbage bag roll 36 to retrieve a portion of one trash liner 38 from the garbage bag roll 36. The threading step comprises threading the one trash liner 38 through the elongated slot 32 in the bottom plate 30 of the bucket 26. The swiveling step comprises swiveling downwardly the bottom plate 30 of the bucket 26 onto the base 12 into a closed position when the one trash liner 38 is threaded through the elongated slot 32 in the bottom plate 30 of the bucket 26. The clamping step comprises clamping the spring latch 16 to the ridge 34 when the bottom plate 30 of the bucket 26 is in the closed position. The securing step comprises securing a portion of the threaded trash liner over the top rim 28 of the bucket 26.

Referring now to FIG. 1 which depicts a perspective view of an preferred embodiment of the automatic lining refuse receptacle device showing a base 12; a spring latch 16; a bucket 26; a ridge 34; and one trash liner 38. The ridge 34 is shown attached to the bucket 26, wherein the ridge 34 is also show attached onto with the spring latch 16. A portion of the trash liners 38 of the optional garbage bag roll 36 is shown enveloped around the top rim 28 of the bucket 26.

Figure 2:
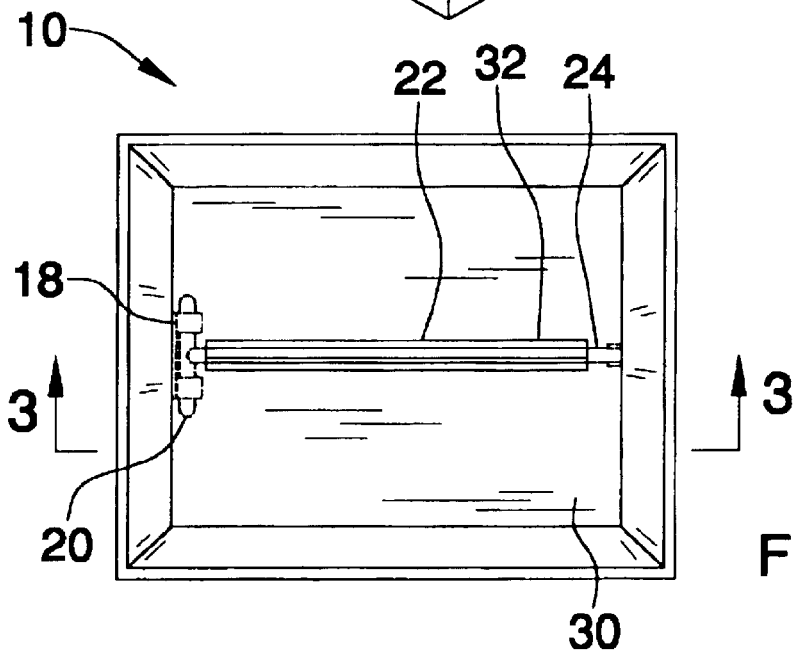
FIG. 2 is a top view of a portion of a preferred embodiment of the automatic lining refuse receptacle device of the present invention.

Referring now to FIG. 2 which depicts a bottom view of a portion of a preferred embodiment of the automatic lining refuse receptacle device showing a base 12; a collar 18; a dowel 20; a spindle 22; a catch 24; and a bottom plate 30 of the bucket 26. The bottom plate 30 of the bucket 26 is shown having an elongated slot 32 cut through the bottom plate 30 of the bucket 26. The distal end of the spindle 22 is shown rotated downwardly towards the base 12 so that the distal end of the spindle 22 is resting on the catch 24 in which the spindle 22 is shown in a dispensing position.

Figure 3:
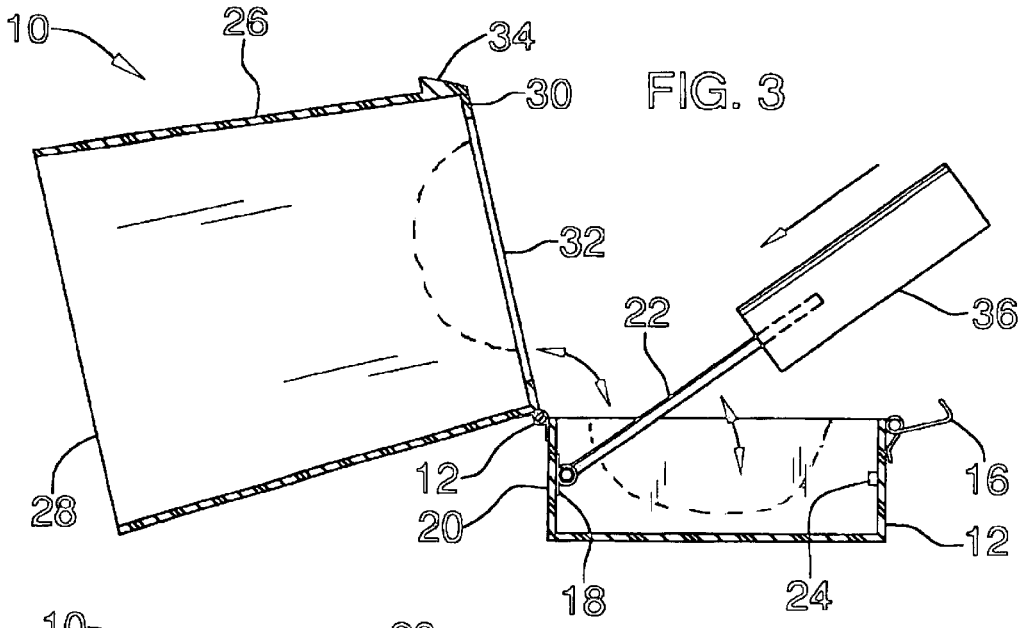
FIG. 3 is a cross sectional side view of a preferred embodiment of the automatic lining refuse receptacle device of the present invention.

Referring now to FIG. 3 which depicts a cross sectional side view of a preferred embodiment of the automatic lining refuse receptacle device showing a base 12; a hinge 14; a spring latch 16; a collar 18; a dowel 20; a spindle 22; a catch 24; a bucket 26; a ridge 34; and a garbage bag roll 36. The hinge 14 is shown attached to the base 12. The spring latch 16 is shown attached to the base 12. The collar 18 is shown attached to the base 12. The dowel 20 is shown pivotally attached to the collar 18. The spindle 22 is shown having distal and proximate ends, in which the proximate end of the spindle 22 is attached to the dowel 20 and the distal end of the spindle 22 is shown holding the garbage bag roll 36. The distal end of the spindle 22 is shown in the load position. The catch 24 is shown attached to the base 12, wherein the catch 24 is shown not contacting the distal end of the spindle 22. The bucket 26 is shown attached to the hinge 14, in which the bucket 26 is shown having a top rim 28 and a bottom plate 30, wherein the bottom plate 30 is shown having an elongated slot 32 cut through the bottom plate 30 of the bucket 26. The ridge 34 is shown attached to the bucket 26, wherein the ridge 34 is capable of being clamped onto with the spring loaded latch. The bottom plate 30 of the bucket 26 is shown rotated upwardly away from the base 12 into an open position when the spring latch 16 is not engaged with the ridge 34. The distal end of the spindle 22 is shown rotated upwardly away from the base 12 into a load position.

Figure 4:
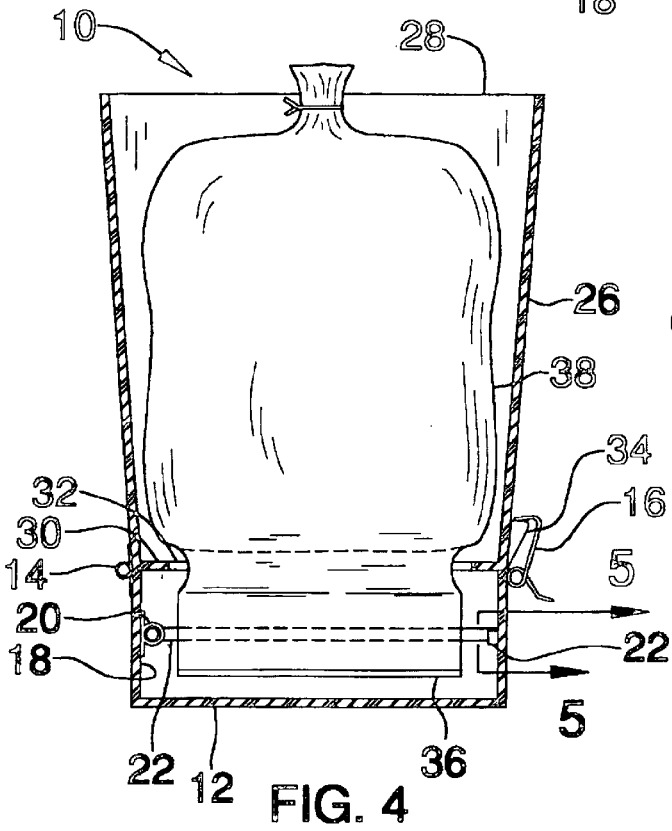
FIG. 4 is a cross sectional side view of a preferred embodiment of the automatic lining refuse receptacle device of the present invention.

Referring now to FIG. 4 which depicts a cross sectional side view of a preferred embodiment of the automatic lining refuse receptacle device showing a base 12; a hinge 14; a spring latch 16; a collar 18; a dowel 20; a spindle 22; a catch 24; a bucket 26; a ridge 34; and a garbage bag roll 36. The hinge 14 is shown attached to the base 12. The spring latch 16 is shown attached to the base 12. The collar 18 is shown attached to the base 12. The dowel 20 is shown pivotally attached to the collar 18. The spindle 22 is shown having distal and proximate ends, in which the proximate end of the spindle 22 is attached to the dowel 20 and the distal end of the spindle 22 is shown holding the garbage bag roll 36. The distal end of the spindle 22 is shown in the dispensing position. The catch 24 is shown attached to the base 12, wherein the catch 24 is shown contacting the distal end of the spindle 22 in the dispensing position. The bucket 26 is shown attached to the hinge 14, in which the bucket 26 is shown having a top rim 28 and a bottom plate 30, wherein the bottom plate 30 is shown having an elongated slot 32 cut through the bottom plate 30 of the bucket 26. The ridge 34 is shown attached to the bucket 26, wherein the ridge 34 is shown being clamped onto with the spring loaded latch. The bottom plate 30 of the bucket 26 is shown rotated downwardly towards the base 12 into a closed position wherein the spring latch 16 is engaged with the ridge 34. The distal end of the spindle 22 is shown rotated downwardly towards the base 12 so that the distal end of the spindle 2 firmly rests on the catch 24 in a dispensing position. A portion of one trash liner 38 of the garbage bag roll 36 is seen inserted through the elongated slot 32 of the bottom plate 30 of the bucket 26 and is also shown enveloping around the top rim 28 of the bucket 26.

Figure 5:
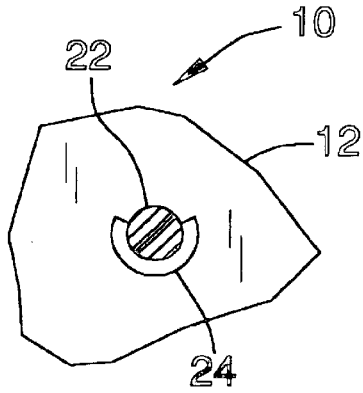
FIG. 5 is a cross sectional view of the spindle contacting a collar of a preferred embodiment of the automatic lining refuse receptacle device of the present invention.

Referring now to FIG. 5 which depicts a cross sectional view of the spindle contacting a collar of a preferred embodiment of the automatic lining refuse receptacle device showing the base 12, the spindle 22, and the catch 24. The spindle 22 is shown distal end of the spindle 2 is shown firmly resting on the catch 24 in a dispensing position.

As to the manner of usage and operation of the present invention, the same should be apparent from the above description. Accordingly, no further discussion relating to the manner of usage and operation will be provided.

While a preferred embodiment of the automatic lining refuse receptacle device has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the is specification are intended to be encompassed by the present invention.

Throughout this specification, unless the context requires otherwise, the word "comprise" or variations such as "comprises" or "comprising" or the term "includes" or variations, thereof, or the term "having" or variations, thereof will be understood to imply the inclusion of a stated element or integer or group of elements or integers but not the exclusion of any other element or integer or group of elements or integers. In this regard, in construing the claim scope, an embodiment where one or more features is added to any of the claims is to be regarded as within the scope of the invention given that the essential features of the invention as claimed are included in such an embodiment.

Those skilled in the art will appreciate that the invention described herein is susceptible to variations and modifications other than those specifically described. It is to be understood that the invention includes all such variations and modifications which fall within its spirit and scope. The invention also includes all of the steps, features, compositions and compounds referred to or indicated in this specification, individually or collectively, and any and all combinations of any two or more of said steps or features.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A lining refuse receptacle device comprising:

a base;

a hinge attached to said base;

a spring latch attached to said base;

a collar attached to said base;

a dowel pivotally attached to said collar;

a spindle having distal and proximate ends, said proximate end of said spindle is attached to said dowel;

a catch attached to said base, wherein said catch is contacting said distal end of said spindle;

a bucket attached to said hinge, said bucket having a top rim and a bottom plate, wherein said bottom plate having an elongated slot cut through said bottom plate of said bucket; and a ridge attached to said bucket, wherein said ridge is capable of being clamped onto with said spring latch.

2. The device of claim 1 further comprising a garbage bag roll slidably attached to said spindle, said garbage bag roll comprising a continuous length of a plurality of separable trash liners, wherein one trash liner at a time can be retrieved by partially unwinding said garbage bag roll.

3. The device of claim 2 wherein said garbage bag roll is made of plastic selected from the group consisting of rubber, neoprene, polyvinyl chloride, polyester, polyethylene, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

4. The device of claim 1 wherein said bottom plate of said bucket can be rotated upwardly away from said base into an open position when said spring latch is not engaged with said ridge.

5. The device of claim 1 wherein said bottom plate of said bucket can be rotated downwardly towards said base into a closed position wherein said spring latch is engageable with said ridge.

6. The device of claim 1 wherein said distal end of said spindle can be rotated upwardly away from said base into a load position.

7. The device of claim 1 wherein said distal end of said spindle can be rotated downwardly towards said base so that said distal end of said spindle rests on said catch in a dispensing position.

8. The device of claim 1 wherein said bucket is made of plastic selected from the group consisting of rubber, neoprene, polyvinyl chloride, polyester, polyethylene, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

9. The device of claim 1 wherein said base is made of plastic selected from the group consisting of rubber, neoprene, polyvinyl chloride, polyester, polyethylene, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

10. The device of claim 1 wherein said spindle is made of plastic selected from the group consisting of rubber, neoprene, polyvinyl chloride, polyester, polyethylene, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

11. The device of claim 1 wherein said spring latch is made of metal.

12. The device of claim 1 wherein said spring latch is made of plastic selected from the group consisting of rubber, neoprene, polyvinyl chloride, polyester, polyethylene, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

13. The device of claim 1 wherein said collar is made of plastic selected from the group consisting of rubber, neoprene, polyvinyl chloride, polyester, polyethylene, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

14. The device of claim 1 wherein said dowel is made of plastic selected from the group consisting of rubber, neoprene, polyvinyl chloride, polyester, polyethylene, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

15. The device of claim 1 wherein said hinge is made of plastic selected from the group consisting of rubber, neoprene, polyvinyl chloride, polyester, polyethylene, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

16. The device of claim 1 wherein said ridge is made of plastic selected from the group consisting of rubber, neoprene, polyvinyl chloride, polyester, polyethylene, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

17. The device of claim 1 wherein said hinge is a piano hinge.

18. The device of claim 1 wherein said catch is made of plastic selected from the group consisting of rubber, neoprene, polyvinyl chloride, polyester, polyethylene, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

19. A kit for an automatic lining refuse receptacle device, said kit comprising:

a base;

a hinge attached to said base;

a spring latch attached to said base;

a collar attached to said base;

a dowel pivotally attached to said collar;

a spindle having distal and proximate ends, said proximate end of said spindle is attached to said dowel;

a catch attached to said base, wherein said catch is contacting said distal end of said spindle;

a bucket attached to said hinge, said bucket having a top rim and a bottom plate, wherein said bottom plate having an elongated slot cut through said bottom plate of said bucket;

a ridge attached to said bucket, wherein said ridge is capable of being clamped onto with said spring latch; and a garbage bag roll slidably attachable to said spindle, said garbage bag roll comprising a continuous length of a plurality of separable trash liners, wherein one trash liner at a time can be retrieved by partially unwinding said garbage bag roll.

20. A method of using a kit for a lining refuse receptacle device, the method comprising the steps of:

obtaining the kit comprising:

a base;

a hinge attached to the base;

a spring latch attached to the base;

a collar attached to the base;

a dowel pivotally attached to the collar;

a spindle having a distal and proximate ends, the distal end of the spindle is attached to the dowel;

a catch attached to the base, wherein the catch is contacting the distal end of the spindle;

a bucket attached to said hinge, the bucket having a top rim and a bottom plate, wherein the bottom plate having an elongated slot cut through the bottom plate of the bucket;

a ridge attached to the bucket, wherein the ridge is clamped onto with the spring latch; and a garbage bag roll slidably attachable to the spindle, the garbage bag roll comprising a continuous length of a plurality of separable trash liners, wherein one trash liner at a time can be retrieved by partially unwinding the garbage bag roll;

unclamping the spring latch from the ridge;

rotating upwardly the bottom plate of the garbage away from the base into an open position, wherein said rotating step performed when the spring latch is unclamped, gyrating upwardly the distal end of the spindle away from the base into a load position;

grabbing hold of the garbage bag roll;

inserting slidably the spindle through the garbage bag roll when the spindle is in the load position;

revolving downwardly the distal end of the spindle towards the base so that the distal end of the spindle contacts onto on the catch wherein said rotating step places the spindle in a dispensing position wherein said rotating step performed subsequent to said inserting step and performed when the spindle is inserted through the garbage bag roll;

unwinding partially the garbage bag roll to retrieve a portion of one trash liner from the garbage bag roll;

threading the one trash liner through the elongated slot in the bottom plate of the bucket;

swiveling downwardly the bottom plate of the bucket onto the base into a closed position when the one trash liner is threaded through the elongated slot in the bottom plate of the bucket;

clamping the spring latch to the ridge when the bottom plate of the bucket is in the closed position; and securing a portion of the threaded trash liner over the top rim of the bucket.

* * * * *